US005524399A

United States Patent [19]

Reum et al.

[11] Patent Number: 5,524,399

[45] Date of Patent: Jun. 11, 1996

[54] LANDSCAPE POND

[75] Inventors: Mark T. Reum, Albany; Nick J. Demuth, Paynesville, both of Minn.

[73] Assignee: Avon Plastics, Inc., Albany, Minn.

[21] Appl. No.: 368,659

[22] Filed: Jan. 4, 1995

[51] Int. Cl.[6] ..... E04H 4/12

[52] U.S. Cl. ..... 52/169.7; 4/492; 4/507

[58] Field of Search ..... 52/169.7; 472/134; 4/492, 496, 506, 507

[56] References Cited

U.S. PATENT DOCUMENTS

| | | | |
|---|---|---|---|
| 3,030,028 | 4/1962 | Hruby | 4/496 X |
| 3,722,816 | 3/1973 | Stewart et al. | 4/492 X |
| 4,263,759 | 4/1981 | Miller | 52/169.7 |
| 4,510,632 | 4/1985 | Elsis | 4/506 X |
| 4,920,465 | 4/1990 | Sargent | 4/496 X |
| 4,948,296 | 8/1990 | Salter | 52/169.7 X |
| 5,192,162 | 3/1993 | McKinnon | 52/169.7 X |

*Primary Examiner*—Carl D. Friedman
*Assistant Examiner*—Beth A. Aubrey
*Attorney, Agent, or Firm*—Merchant, Gould, Smith, Edell, Welter & Schmidt

[57] ABSTRACT

A molded plastic landscape pond is disclosed that is installed into the ground, the pond having a peripheral rim at or slightly above level. A hollow molded plastic pedestal interlocks onto the bottom surface of the pond, and a molded plastic statue is mounted on top of the pedestal. A submersible pump disposed in the hollow pedestal pumps water to the statue, which generates a stream or spray of water into the pool.

16 Claims, 6 Drawing Sheets

LANDSCAPE POND

BACKGROUND OF THE INVENTION

The invention is directed to a landscape pond and pedestal mounted statue.

Landscape ponds have long been used to enhance the aesthetic appearance of gardens and other landscaped areas. Typically, such landscape pools are relatively difficult to construct, requiring techniques and materials that most homeowners have difficulty in using. As such, the installation of such pools necessitates the use of professionals, which renders them unaffordable to most homeowners. Conventional landscape pools are also somewhat difficult to clean and otherwise maintain.

The inventive landscape pool is the result of an endeavor to produce a device which enables homeowners to enjoy the benefits of such ponds, but without the complexity of installation and maintenance as well as associated expense.

The inventive landscape pool comprises a pool body that may vary in size and configuration depending on the type of installation desired. Preferably, the pool body is molded from polyethylene which is substantially rigid or at least semi-rigid, and is installed by placing it in a hole dug in the ground which is of complementary size and configuration. Soil is backfilled against the external sides of the pool body to lend support when it is filled. A peripheral rim of the pool body is disposed at or slightly above ground level.

The inventive landscape pool further comprises a pedestal that is removably mounted on the pool bottom surface and adapted to receive a statue. In the preferred embodiment, the pedestal is a hollow, molded polyethylene member having a dovetailed recess that interlocks with a dovetailed projection in the bottom pool surface. The pedestal is disposed below water level and is adapted to receive and house a conventional submersible pump.

A statue (e.g., a depiction of a frog or turtle) is mounted on the top of the pedestal and constructed to receive water from the pump and to generate a stream or spray of water into the pool. The statue is angularly adjustable relative to the pedestal to direct the stream of water in a desired direction.

In a preferred embodiment, the pedestal and statue may also be mounted on a platform that projects externally and laterally of the pool so that the stream of water is directed from an elevated point back into the pool. In either case, water in the pool is continuously circulated to prevent stagnation as well as to aesthetically enhance the pool.

In the preferred embodiment, the pool also includes multiple levels, defining shallow pools for aquatic plants. A plurality of separate pools may also be installed at different levels in a cascading fashion.

As constructed, the inventive landscape pool is relatively light weight, easy to install and resistant to the damaging effect of the sun's ultraviolet rays. It may be easily installed by individual homeowners without the difficulty or expense normally associated with conventional landscape ponds, and results in an aesthetically pleasing installation that enhances the homeowner's yard and garden.

DESCRIPTION OF THE PREFERRED EMBODIMENTS

Figure 1:
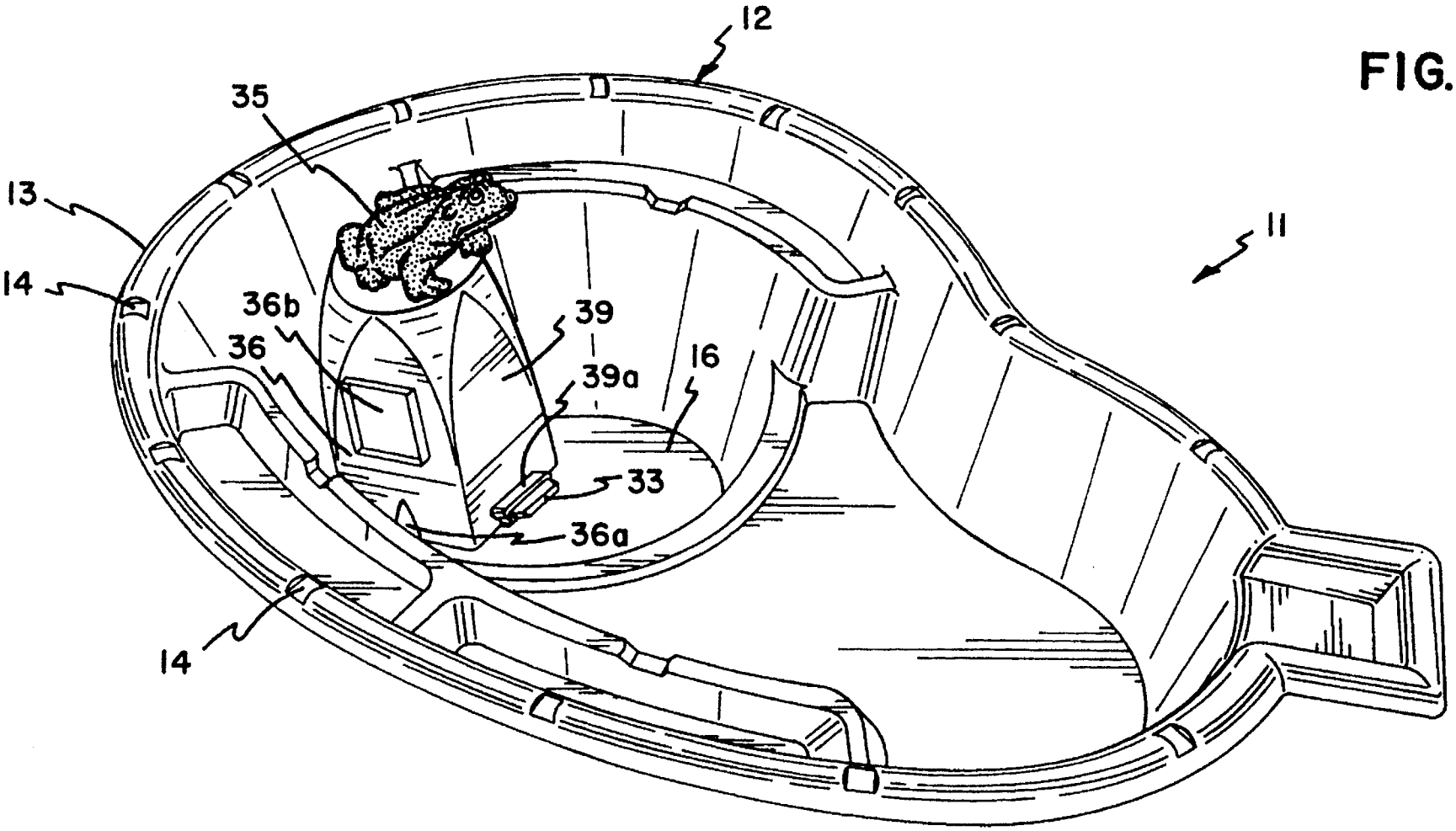
FIG. 1 is a perspective view of a landscape pool embodying the invention.
Figure 2:
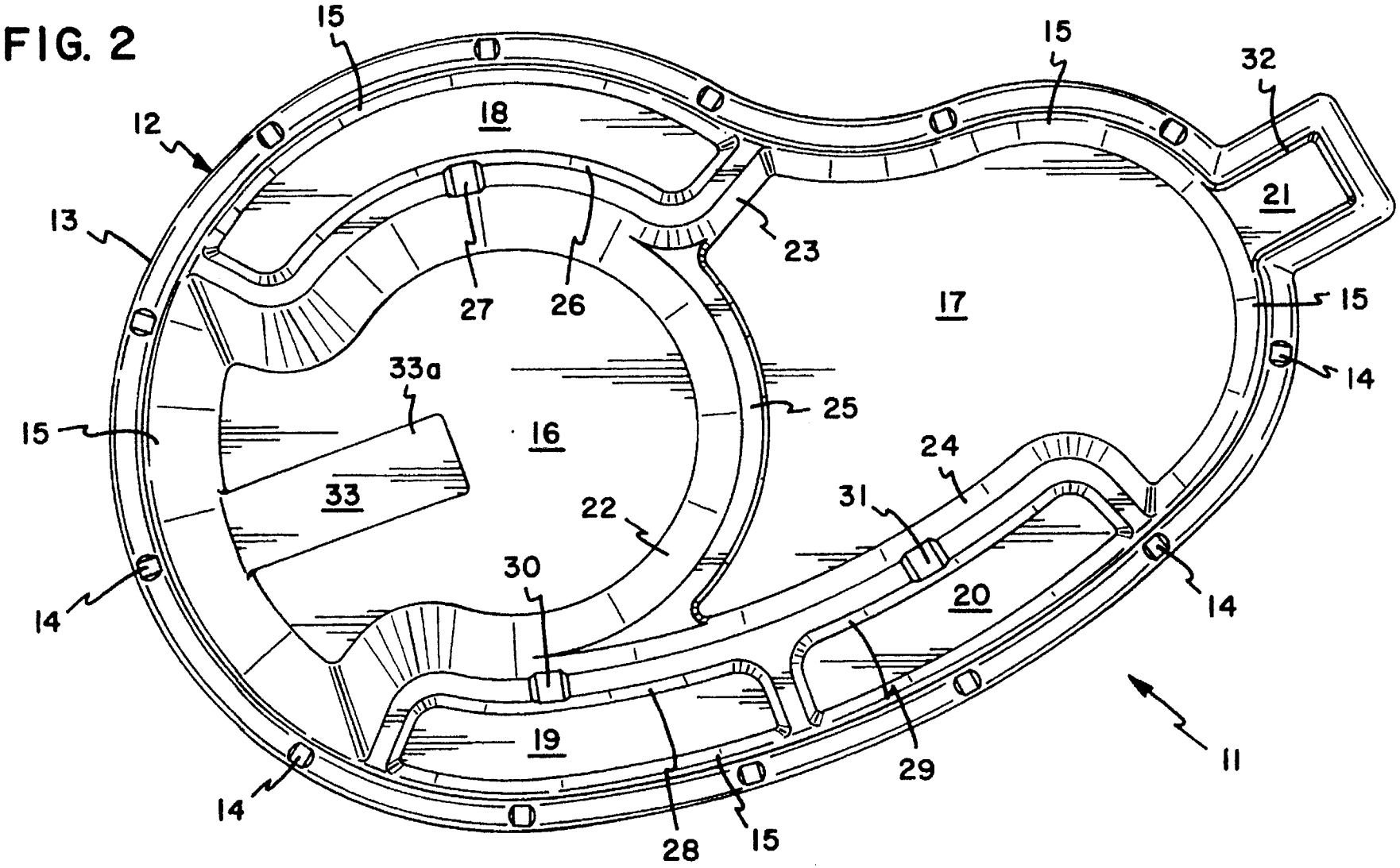
FIG. 2 is a view on top plan of the inventive landscape pool.

With initial reference to FIGS. 1 and 2, a landscape pool embodying the invention is represented generally by the numeral 11. Landscape pool comprises a multi-level, variable depth pool body 12 of irregular configuration constituting an impermeable receptacle suitable for receiving and holding water in the manner of a garden pond. In the preferred embodiment, and as best shown in FIG. 2, pool body 12 is generally kidney shaped, although other aesthetically pleasing configurations may be used. Pool body 12 is preferably molded from polyethylene, and it may be manufactured from recycled material. Its wall thickness is sufficiently thick to make it relatively rigid or at least semi-rigid, and thus capable of receiving and storing a volume of water. However, and as described in further detail below, the pool body is intended to be installed below ground level with back fill around its sides to provide additional support when filled with water.

In the preferred embodiment, pool body 12 has an overall length of approximately 5½ feet, an overall width of approximately 3½ feet and a maximum depth of approximately 1½ feet. In this kidney shaped configuration and with such dimensions, pool body 12 is designed to contain approximately 70 gallons of water.

The external configuration of pool body 12 is defined by a peripheral rim 13 that represents the highest point or elevation of the body 12. When installed, the rim, which is generally convex in shape, is disposed in a horizontally level position and elevated slightly above the ground to prevent dirt, gravel or the like from falling into the pond. A plurality of depressions or recesses 14 are formed in and spaced around rim 13 and which perform several functions. First, they provide a variety of positions in which the electric cord of a submersible pump (described below) may lead from the pool, depending on orientation of the pool and the direction of the nearest electrical outlet. Second, the recesses 14 increase the rigidity and strength of the rim 13. Third, the recesses 14 enhance the aesthetic appearance of the rim 13.

Body 12 is formed with a continuous sidewall 15 that extends downwardly and slightly inward from the rim 13 (see FIG. 2) to a plurality of irregularly shaped bottom surfaces 16–21 that are disposed at multiple levels, each being substantially horizontal in the installed position. Bottom surface 16 defines the maximum depth of body 12 and the deepest portion of the pool. An irregular sidewall 22 projects upwardly from bottom surface 16 and merges laterally with the main sidewall 15. Bottom surface 17 defines the next level upward from bottom surface 16. Bottom surface 17 cooperates with discontinuous sidewall portions 23, 24, which respectively merge laterally with the sidewall 22 and main sidewall 15. A ridge member 25 which is slightly elevated from bottom member 17 extends between sidewalls 23, 24.

Bottom surface 18 is elongated and arcuate, and together with a sidewall 26 which merges laterally with main sidewall 15, defines a shallow peripheral pool in which aquatic plants may be planted. A recess 27 formed in the sidewall 26 serves as a spillway from this shallow pond into the deeper pond defined by bottom surface 16.

Bottom surfaces 19, 20 are also elongated and slightly arcuate. Sidewalls 28, 29, which are respectively associated with bottom members 19, 20, both merge laterally with main sidewall 15 to form additional shallow peripheral pools for aquatic plants. A spillway 30 is formed in sidewall 28, and a similar spillway 31 is formed in sidewall 29, both permitting water in the associated shallow pools to spill into the larger and deeper central pools.

Bottom surface 21 and an associated sidewall 32 (which also merges with main sidewall 15) together define the shallowest pool, which communicates directly with the pool defined by bottom surface 17. This shallowest pool projects laterally outward from the main portion of body 12 and has a purpose described in further detail below.

Figure 3:
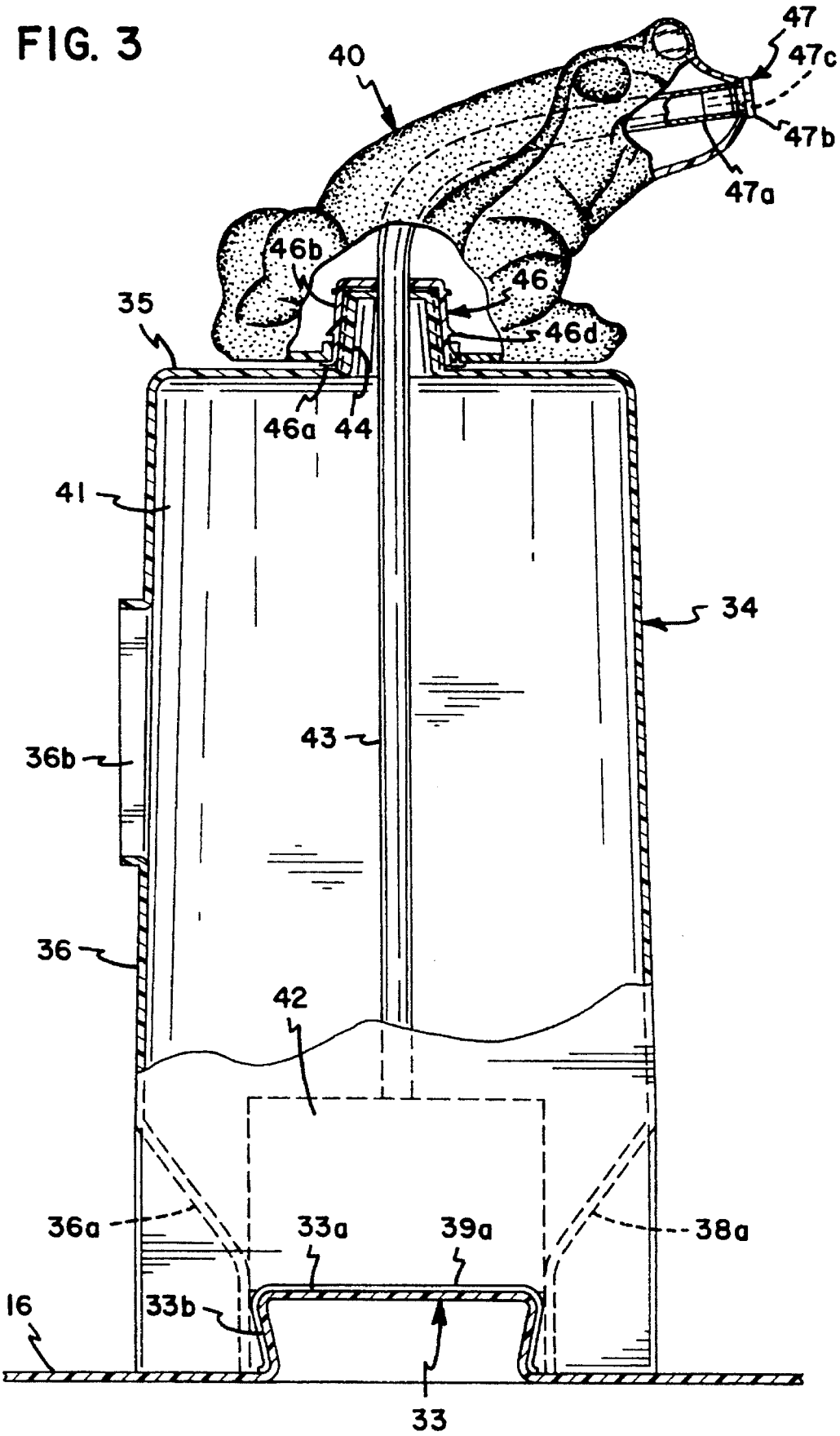
FIG. 3 is an enlarged transverse sectional view of a statue pedestal and statue for the landscape pool.

With reference to FIGS. 1–3, an interlocking member 33 projects upwardly from the surface of bottom surface 16. As best shown in FIG. 1, this interlocking member 33 is of a dove-tailed configuration, having a flat upper surface 33*a* with converging elongated sides 33*b*. The length of interlocking member 13 is approximately half of the overall length of bottom member 16.

With specific reference to FIG. 3, a pedestal bearing the general reference numeral 34 is interlockably mounted on member 33. Pedestal 34 is generally rectangular in cross section and stands upright to receive a statue 40, which in the preferred embodiment takes the form of a frog. The term "statue" as used herein means a three-dimensional representation of an animal, person or object, particularly of the type found in landscape pools, fountains and the like.

Figure 4:
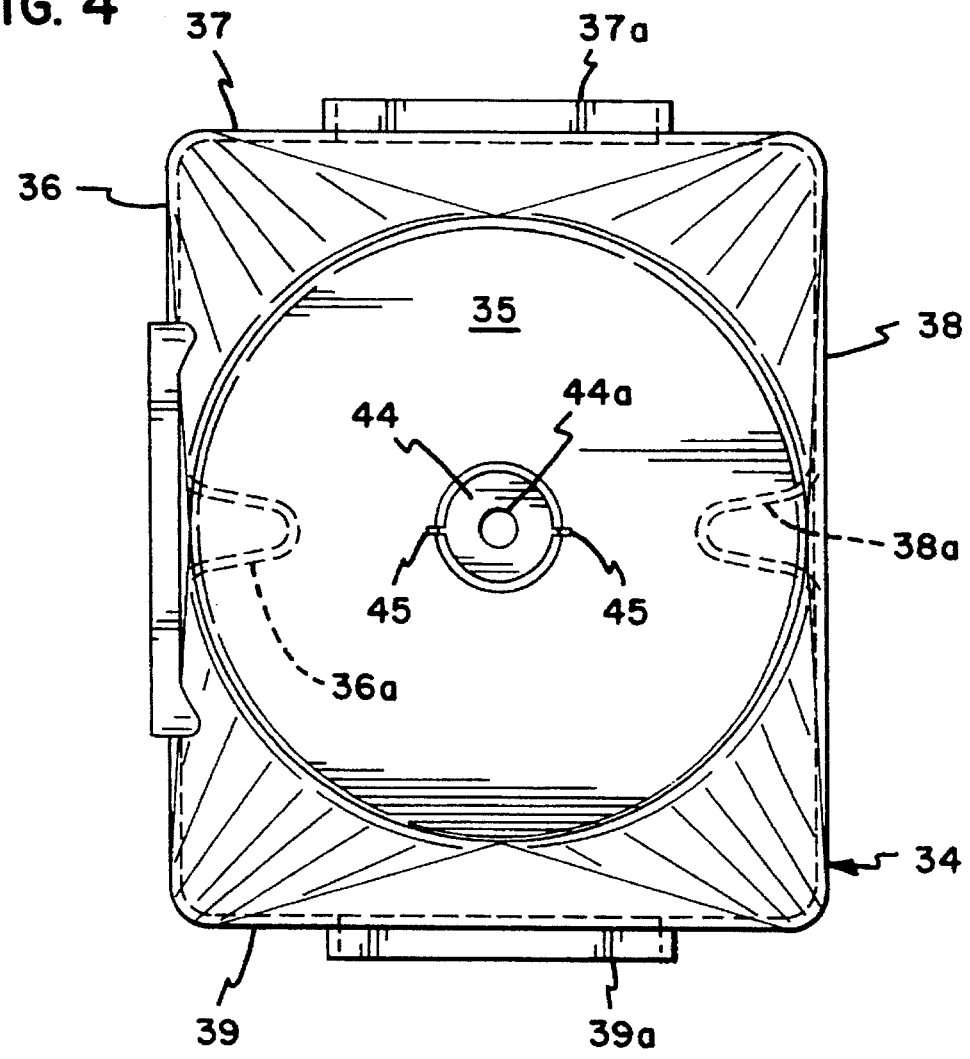
FIG. 4 is a top plan of the statue pedestal.

With reference to FIGS. 1, 3 and 4, pedestal 34 in its preferred form is a hollow, plastic molded component (preferably molded from polyethylene) of generally rectangular configuration both in longitudinal section (FIG. 3) and transverse section (FIG. 4). Preferably, its height is greater than its transverse dimensions. It has an open bottom, a circular elevated top surface 35 and four sidewalls 36–39. Each of the sidewalls 36–39 is generally rectangular at the bottom of the pedestal 34 and converges to a tapered top area that defines the circular elevated top surface 35. The four sidewalls 36–39 and top surface 35 define an internal chamber 41, which is filled with water when the landscape pool 11 is installed and operational.

With specific reference to FIGS. 3 and 4, sidewalls 37, 39 respectively define dovetailed recesses 37*a*, 39*a* centered along their lower edges. As shown in FIG. 4, the dovetail recesses 37*a*, 39*a* are spaced by the distance between sidewalls 37, 39, and they are disposed in alignment. As shown in FIG. 3, they complement the interlocking dovetailed member 33 of bottom surface 16. The transverse dimension of pedestal 34 between sidewalls 37, 39 is less than the length of the dovetailed projection 33, which permits pedestal 34 to be placed adjacent the projection 33 and to slide over it in an interlocking, track-like manner. Pedestal 34 may be linearly adjusted to any point along the projection 33. The frictional relationship between projection 33 and recesses 37*a*, 39*a* prevent lateral movement of the pedestal once installed.

With continued reference to FIGS. 1, 3 and 4, sidewalls 36, 38 are formed with internally recessed walls 36*a*, 38*a* that provide a vertical stiffening function and also present an increased lower peripheral edge on which the pedestal 34 rests. In addition, and as particularly shown in FIG. 3, the walls 36*a*, 38*a* project inwardly a sufficient distance to engage the dovetailed projection 33 when pedestal 34 is installed, thus providing increased support.

Sidewall 36 is formed with a rectangular access opening 36*b* above its midpoint. Access opening 36*b* permits water to enter the internal chamber 41, and also permits access to the internal chamber 41 for installing a submersible pump 42. Pump 42 is of conventional construction, and preferably rests on the top flat surface 33*a* of dovetailed projection 33. Top surface 33*a* is of sufficient size to accommodate a number of commercially available submersible pumps. Pump 42 has a water inlet (not shown) and an outlet to which a flexible tube or conduit 43 is connected.

With reference to FIGS. 3 and 4, pedestal 34 is formed with a statue mounting projection 44 that extends upwardly from the center of the elevated top surface 35. Mounting projection 44 is circular in configuration (FIG. 4) and its sidewall tapers slightly from its base to a top flat surface (FIG. 3), thus defining a small tapered cylinder. A pair of diametrically opposed splines 45 are formed at the base of mounting projection 44.

Figure 5:
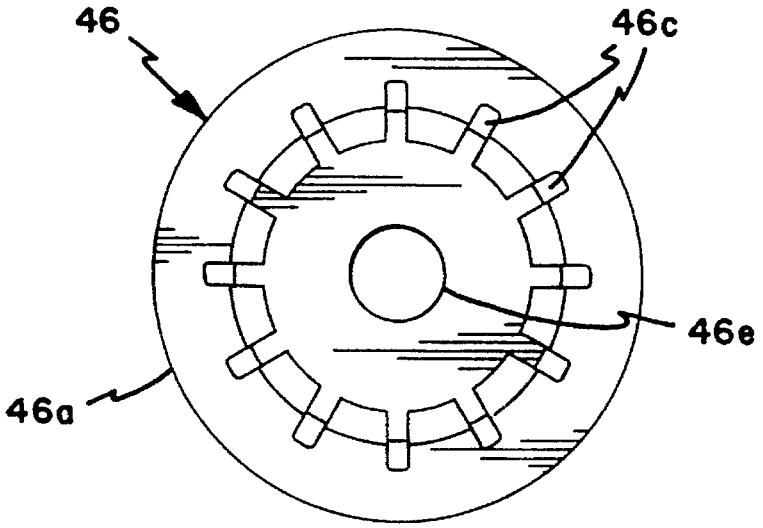
FIG. 5 is a bottom plan view of an adjustable mount for mounting a statue to the statue pedestal.

With reference to FIGS. 3 and 5, an adjustable mounting member 46 for statue 40 bears the general reference numeral 46. Mounting member 46 is molded from a flexible, resilient material, and it includes a circular base flange 46*a* and a circular body 46*b* that projects upwardly from the base flange 46*a*. Body 46*b* is tapered internally as well as sized to fit over the mounting projection 44 in complementing relation (FIG. 3). As shown in FIG. 5, a plurality of splined receiving recesses are formed in the base of mounting member 46, which are sized to receive and engage the splines 45. The spline receiving recesses 46*c* consist of diametrically opposed recess pairs, permitting the statue mounting member 46 to be placed over the mounting projection 44 at a selected angular position.

As shown in FIG. 3, the outer surface of statue mounting member 46 also takes the form of a tapered cylinder, and it is formed with a circumferential barb 46*d* that is spaced above the circular flange 46*a*. Statue 40 is a hollow molded article having a circular mounting hole formed in its bottom wall, the diameter of which corresponds to the diameter of statue mounting member 46 at its base. The circumferential barb 46*d* has a slightly greater diameter than the mounting hole in statue 40 and is flexible and resilient. As such, and as shown in FIG. 3, the statue mounting member 46 is forcibly inserted into the mounting hole in plug fashion until the circumferential barb 46*d* passes through and expands on the inner side. The mounting member or plug 46 is then retainably positioned in the mounting hole with the bottom wall retained between the barb 46*d* and the flange 46*a*.

With the mounting member 46 so inserted, the statue 40 and member 46 may now be adjustably positioned on projecting member 44 in a desired orientation, with selected spline receiving recesses 46*c* fitting over the splines 45.

With reference to FIGS. 3, 4 and 5, mounting projection 44 is formed with a central opening 44*a* in its top surface (FIG. 4), and a similar opening 46*e* is formed in the mounting member 46 (FIG. 5). Both of these openings are sized to permit the flexible tube 43 to be inserted therethrough into the hollow body of statue 40. Statue 40 has a circular outlet opening that is disposed at the mouth of the frog which the statue depicts, and an outlet fitting 47 is inserted into this opening. Fitting 47 comprises a cylindrical body 47*a* that projects into the statue 40 and a circular flange 47*b* that externally positions the fitting. A water outlet opening 47*c* is formed through the flange 47*b*.

The outer diameter of body 47*a* is slightly larger than the inside diameter of flexible tube 43, permitting the tube 43 to fit over and be frictionally retained on the body 47*a*. This enables the output of submersible pump 42 to be directed through the tube 43 and fitting 47, thus giving the appearance that the resulting stream of water emanates from the frog's mouth.

Landscape pool 11 is installed by digging a hole of approximately the size and configuration of the pool 11, inserting the pool and leveling it so that the peripheral rim 13 is horizontal. Soil is then backfilled relative to the external sides of the pool 11 to provide adequate support when the pool is filled with water.

Pedestal 34 is then installed by placing it adjacent the dovetailed projection 33 and sliding the pedestal 34 in track-like fashion so that the dovetailed recesses 39*a* slide over the projection 33. As indicated above, pedestal 34 may be positioned at any point on projection 33. With the pedestal 34 properly installed, submersible pump 42 is inserted through access opening 36*b* and placed on the top flat surface 33*a* of projection 33. Electric cord for pump 42, which is not shown in the drawings, leads out through access opening 36*b* and is placed in the recess 14 of peripheral rim 13 which is closest to an electric outlet. The electric cord may thereafter be buried beneath the soil adjacent the pond.

To mount the statue 40, fitting 47 is inserted into the outlet opening at the frog's mouth, and flexible tube 43 is inserted through the large mounting opening in the statue base and inserted on to the fitting 47. Mounting member 46 is then inserted on to the free end of flexible tube 43 and moved along the tube until it projects into the mounting opening in the base wall of statue 40. Mounting member 46 is then forcibly pressed into this mounting opening until the resilient circumferential barb 46*d* projects through the opening, thus retaining member 46 in the position shown in FIG. 3. The free end of flexible tube 43 is then inserted through the opening 44*a* in the projecting member 44, and statue 40 can be adjustably mounted by orienting the frog mouth in the desired direction for the water stream to emanate. Statue 40 is then mounted by placing the mounting member 46 over the projecting member 44 with a selected pair of splined receiving recesses 46*c* over the splines 45. The final installation step is to connect the free end of flexible tube 43 to the outlet of submersible pump 42.

Pool 11 is then filled with water to a level that is just slightly over the top surface 35 of pedestal 34. At this level, water not only covers pedestal 34 but also enters the internal chamber 41 through access opening 36*b*. With the electric cord of submersible pump 42 plugged into a source of electric power, pump 42 draws water into its inlet and a stream of water emanates from the fitting 47. The water recirculates continuously as water from the frog's mouth enters the pool and then returns to the pump 42. This is not only aesthetically pleasing but also avoids stagnation of the pond water.

Figure 6:
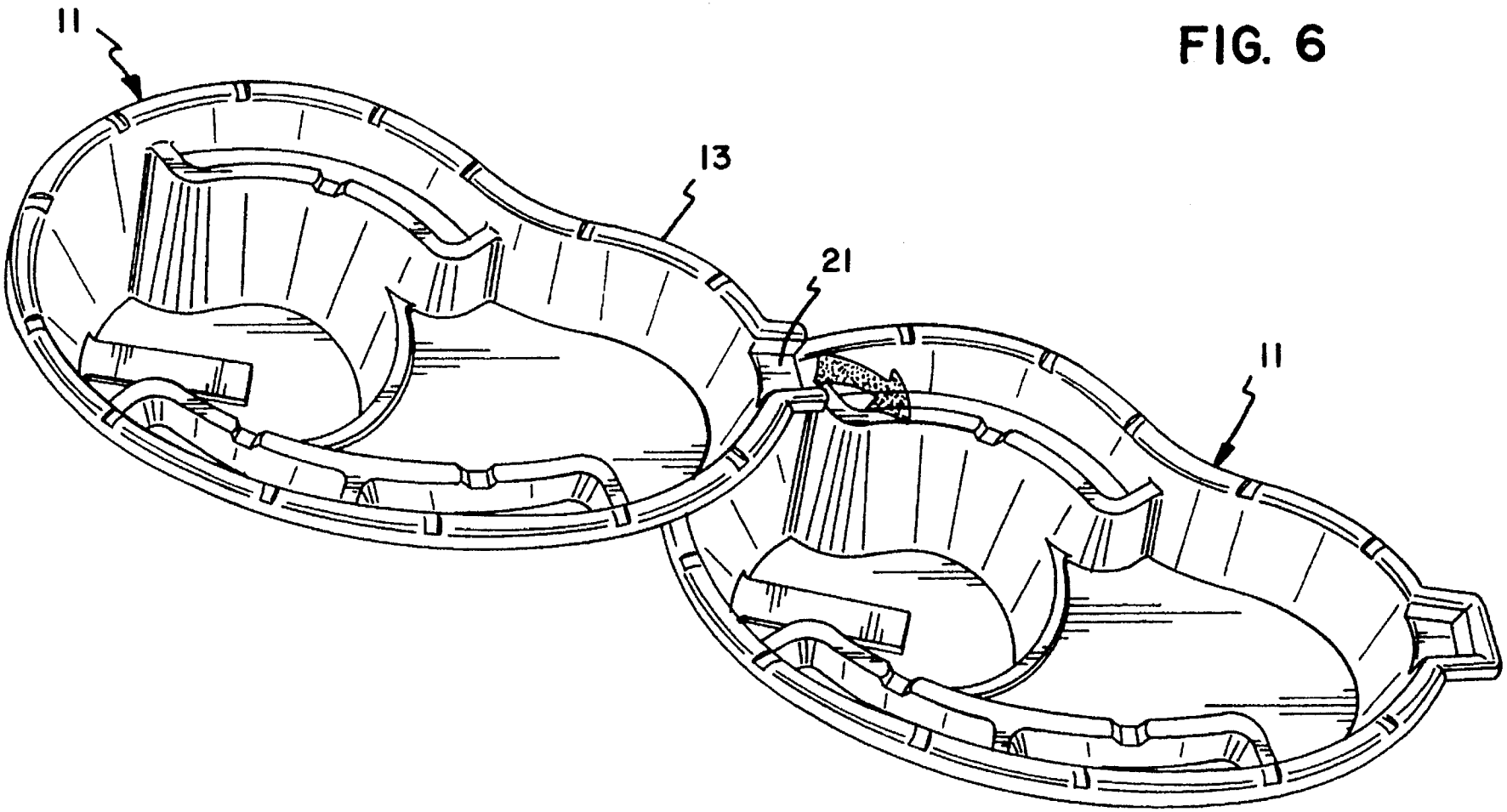
FIG. 6 is a perspective view of two of the inventive landscape pools shown in cascading relation.

An alternative embodiment which utilizes two landscape pools 11 is shown in FIG. 6. As shown, a first pool 11 is installed at a lower level, and an upper pool 11 is installed at a higher elevation with its end, including the shallowest pool 21, overlying the lower landscape pool 11. The peripheral rim at the extreme end of shallow pool 21 is cut away, enabling water in the upper pool 11 to flow into the lower pool 11 on a continuous basis. To accomplish a continuous flow, a long flexible tube leading from the outlet of the submersible pump 42 in the lower landscape pool 11 leads into the upper landscape pool 11 and its statue 40. This embodiment may also use one or more additional statues in the manner described above.

Figure 7:
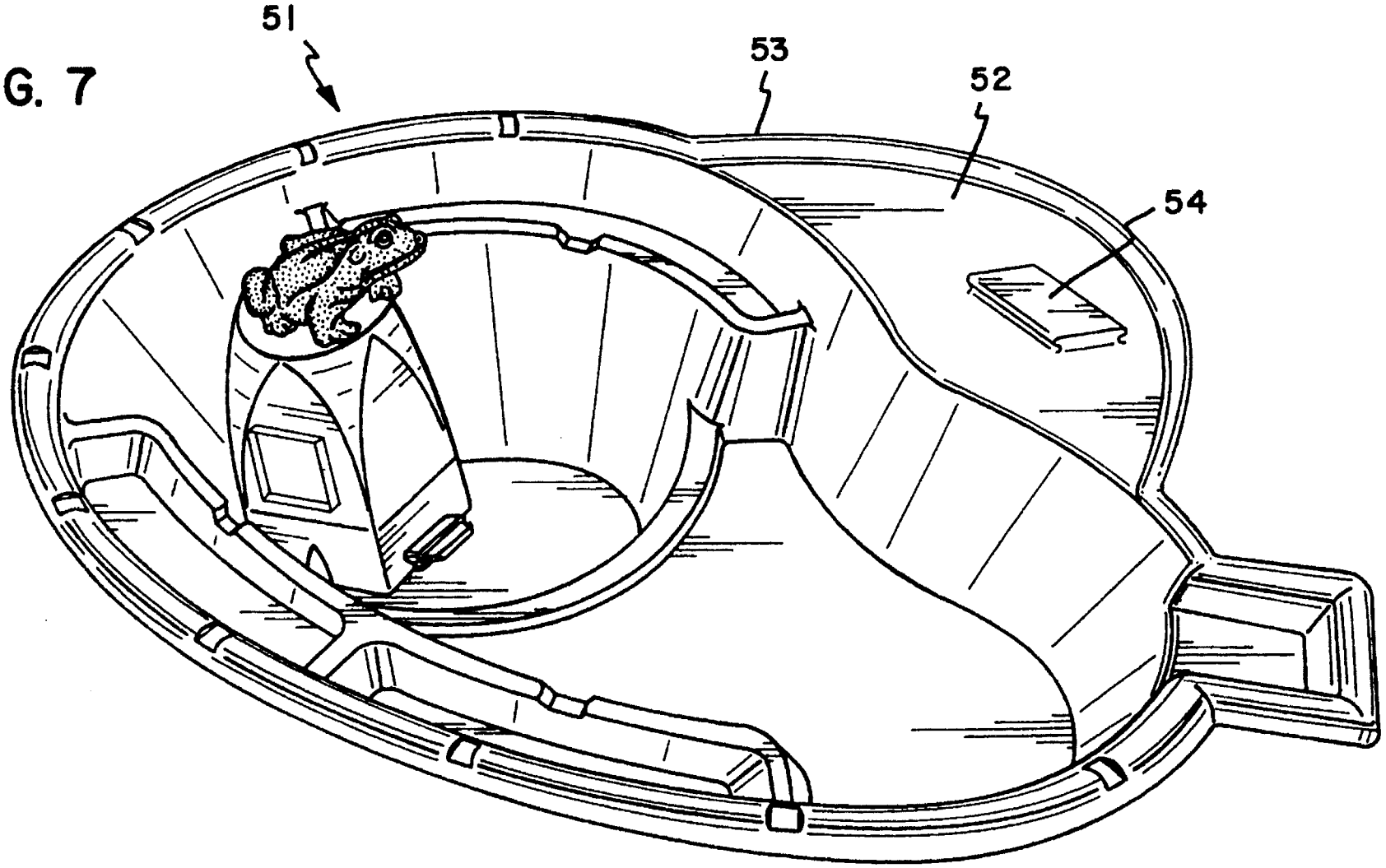
FIG. 7 is a perspective view of an alternative embodiment of the landscape pool.

An alternative embodiment to the landscape pool itself is shown in FIG. 7. This alternative landscape pool, which bears the general reference numeral 51, is structurally similar to the landscape pool 11, and like components bear like reference numerals. The primary structural difference resides in the inclusion of a laterally projecting surface 52 and an extended peripheral rim 53 that borders surface 52 as well as the other portions of the pool 51. A dovetailed interlocking member 54 which is structurally the same as the dovetail projection 33 projects upwardly from surface 52. Laterally projecting surface 52 is intended to rest on adjacent soil for proper support.

A pedestal 34 and accompanying statue 40 are mounted on the dovetailed projection 54, with the statue oriented to issue a stream of water toward the pool. However, since the pedestal 34 resting on surface 52 is not below the water level, it is necessary to locate the associated submersible pump within the pool under the water level, and to feed the flexible tube 43 from the pump 42 into the external pedestal 34 to supply water to the statue 40. Another submerged pedestal 34 and statue 40 mounted in the manner described above may also be used.

The inventive landscape pool and associated components are preferably molded from polyethylene, which is relatively light weight, easy to install and resistent to the potentially degrading effect of the sun's ultraviolet rays. The pool may be used with various aquatic plants in the shallower multilevel pools in addition to the stream issuing statue, and a plurality of the ponds may be arranged in cascading relation with each having its own statue. The pedestals and associated statues may be located within or externally of the pool, and the water streams may be angularly adjusted to accomplish the desired objective. The result is an aesthetically pleasing landscape pond that an individual homeowner may easily install without the difficulty or expense associated with conventional landscape ponds.

What is claimed is:

1. A landscape pool comprising:

a pool body adapted to be installed in the ground, the pool body comprising bottom surface means and sidewall means projecting upwardly therefrom to define a receptacle for holding water, the sidewall means terminating in a peripheral rim;

statue pedestal means supported on said bottom surface means, said pedestal means comprising a hollow housing defining an internal chamber for receiving a submersible pump, the pedestal means having inlet opening means through which water in said pool enters the internal chamber, and said pedestal means further defining an elevated statue supporting top surface;

first mounting means for removably mounting the pedestal means to said bottom surface means;

a statue sized and constructed to be disposed on said elevated top surface, said statue defining a water outlet means;

second mounting means for removably mounting the statue to said pedestal means; and conduit means connected to the water outlet means and adapted for connection to said submersible pump means.

2. The landscape pool defined by claim 1, wherein the bottom surface means of said pool body comprises a plurality of bottom surfaces at different depths to define a multi-level pool.

3. The landscape pool defined by claim 2, wherein one of said bottom surfaces is at the lowest elevation in said pool, and said first mounting means is disposed on said lowest bottom surface.

4. The landscape pool defined by claim 1, wherein said first mounting means comprises means for interlockably connecting the pedestal means to said bottom surface means.

5. The landscape pool defined by claim 4, wherein the first mounting means comprising a dovetailed projection on one of said pedestal means and said bottom surface means, and a complementing dovetailed recess on the other of said pedestal means and bottom surface means.

6. The landscape pool defined by claim 1, wherein said peripheral rim is constructed and arranged to be disposed substantially at ground level when said landscape pool is installed.

7. The landscape pool defined by claim 6, wherein said peripheral rim is disposed in substantially the same horizontal plane in said installed position.

8. The landscape pool defined by claim 7, wherein said peripheral rim has a top surface of convex configuration, and further comprises a plurality of recesses spaced therearound.

9. The landscape pool defined by claim 1, wherein the elevated top surface of said pedestal means is disposed below the level of said peripheral rim.

10. The landscape pool defined by claim 1, wherein said statue is a hollow formed body defining an internal chamber, and said conduit means is partially disposed in the internal chamber of said pedestal means and partially disposed in the internal chamber of said statue.

11. The landscape pool defined by claim 10, wherein the outlet means comprises a fitting carried by said statue and defining a stream defining outlet, said conduit means being connected to said fitting.

12. The landscape pool defined by claim 1, wherein said second mounting means is constructed and arranged to permit angular adjustable movement of said statue relative to said pedestal means.

13. The landscape pool defined by claim 1, wherein said second mounting means comprises:

a first mounting member comprising a tapered cylinder projecting above the elevated top surface of said pedestal means; and a second mounting member carried by said statue, the second mounting member defining a complementing receptacle for receiving said first mounting member.

14. The landscape pool defined by claim 13, wherein said second mounting means further comprises angular adjusting means for adjusting the angular position of the second mounting member relative to the first mounting member.

15. The landscape pool defined by claim 14, wherein the angular adjusting means comprises a pair of diametrically opposed splines disposed on one of said first and second mounting members, and a plurality of pairs of diametrically opposed spline receiving recesses disposed on the other of said first and second mounting means.

16. The landscape pool defined by claim 13, wherein the statue comprises a circular mounting opening of predetermined diameter formed in the base wall thereof for receiving said second mounting member, and the second mounting member comprises a hollow plug member for said opening having a tapered cylindrical inner surface defining said complementing receptacle, and a tapered cylindrical outer surface, a peripheral base flange and a peripheral barbed member spaced from said flange to retainably receive said base wall.

* * * * *